United States Patent [19]

Madland

[11] 4,390,196

[45] Jun. 28, 1983

[54] SLIDING DOOR STARTER AND CLOSER

[75] Inventor: Thorvald Madland, Arlington Heights, Ill.

[73] Assignee: The Youngstown Steel Door Company, Cleveland, Ohio

[21] Appl. No.: 307,880

[22] Filed: Oct. 2, 1981

Related U.S. Application Data

[63] Continuation of Ser. No. 32,386, Apr. 23, 1979.

[51] Int. Cl.[3] ..... E05C 11/00

[52] U.S. Cl. ..... 292/66; 49/278; 292/DIG. 32

[58] Field of Search ..... 292/DIG. 32, 66; 49/449, 276, 278

[56] References Cited

U.S. PATENT DOCUMENTS

| | | | |
|---|---|---|---|
| 1,428,785 | 9/1922 | Kuehner | 49/276 |
| 1,489,648 | 4/1924 | Schmidt . | |
| 1,571,159 | 1/1926 | Posson | 49/277 |
| 1,659,029 | 2/1928 | Julien | 292/DIG. 32 |
| 1,748,257 | 2/1930 | Tobin | 49/277 |
| 1,945,019 | 1/1934 | Busse | 268/72 |
| 2,124,040 | 7/1938 | Olander | 20/22 |
| 2,130,772 | 9/1938 | McBride | 292/DIG. 32 |
| 2,177,325 | 10/1939 | Madland | 292/DIG. 32 |
| 2,267,704 | 12/1941 | Abel | 292/DIG. 32 |
| 2,369,815 | 2/1945 | Coakley | 49/278 X |
| 2,424,381 | 7/1947 | Beauchamp | 292/283 |
| 2,477,112 | 7/1949 | Beauchamp et al. | 268/44 |
| 2,478,688 | 8/1949 | Ditchfield | 292/284 |
| 2,483,611 | 10/1949 | Beauchamp | 292/283 |
| 2,828,994 | 4/1958 | Noble | 292/283 |
| 3,279,839 | 10/1966 | Madland | 292/284 |
| 3,998,484 | 12/1976 | Wolak et al. | 292/283 |
| 4,162,591 | 7/1979 | Madland et al. | 292/DIG. 32 |

*Primary Examiner*—Richard E. Moore

*Attorney, Agent, or Firm*—Bruce M. Winchell

[57] ABSTRACT

A compact door driver is provided on a railway house car for moving a railway car door between a closed or locking position and an open or sliding position. The door driver includes a lever having a crank arm and is rotatably mounted on a structural member of the railway car for movement in excess of 45 degrees. A boss in the form of a roller is mounted on the crank arm. The door driver further includes a door mounted hasp having a cam surface defined end opening in the form of a transverse slot for receiving said boss selectively to drivingly interconnect the lever and the door. When connected to the crank, pivotal movement of the hasp is limited and the hasp, crank arm and boss act similar in manner to a Scotch yoke mechanism. The driver may provide theoretical mechanical advantages substantially within the range of from approximately 8 to 1, to approximately 46 to 1, ignoring friction, depending on the direction of the door and angular position of the crank arm. The railway car door accordingly may be urged between the sliding position and the locking position with a force that is appropriate for the particular position and direction of movement of the door.

5 Claims, 7 Drawing Figures

SLIDING DOOR STARTER AND CLOSER

This application is a continuation, of application Ser. No. 032,386, filed Apr. 23, 1979.

CROSS-REFERENCE TO RELATED APPLICATION

This application is an improvement of co-pending U.S. patent application Ser. No. 763,853 filed Jan. 31, 1977 by Madland and Soddy and assigned to the same assignee now U.S. Pat. No. 4,162,591.

BACKGROUND OF THE INVENTION

The present invention relates to a door driver and more particularly to a door driver which moves a railway house car door between a closed or locking position and an open or sliding position.

When a railway car is in use, cargo is loaded into the railway car by opening the railway car door and moving the cargo to be transported into the car either manually or by mechanical means, such as a lift truck. Once the cargo is loaded into the railway car, the railway car door is closed and locked in that position. When the railway car reaches its destination, the railway car door is unlocked and opened and the cargo is removed from the railway car. In some cases, the cargo is palletized and must necessarily be handled by lift trucks to reduce the labor for loading and unloading operations, considerable damage has been caused to doors and the railway car side parts adjacent to the doorway. For example, the lift hooks of the lift trucks have inadvertently caused such damage by hitting the front stops on the car frame and the front edges of the sliding railway car door. After such damage has been caused, it is extremely difficult to open or close the door manually since there is extreme binding between the front stops on the railway car and the front edges of the railway car door. In the field, a lift truck has been used to move the door into a locking position by exerting substantial force on the door. This operation in turn causes additional damage.

In order to alleviate this problem various modifications to the door engaging members, both on the door and the structural frame of the railway car, have been made. One such modification is moving the door engaging member away from the door opening so that the lift trucks and their pallets do not hit these members. These solutions have reduced the frequency of damage but have not completely eliminated the problem so that it still exists at a lesser frequency.

Present door locking mechanisms have starters and closers that move the door out of or into the locking position over a small distance. One such prior art mechanism is disclosed in Madland U.S. Pat. No. 3,279,839. Madland discloses a lever which is capable of exerting a force on the railway car door which urges the railway car door towards a locking position. This design develops a minimum mechanical advantage and very short door travel under optimum conditions. In most cases of deformation of car side parts or doors, this mechanical advantage is insufficient to move the door far enough and to overcome the binding forces with a force manually applied to the lever. Thus, the use of a lift truck or come-along device is required.

The door driver of co-pending U.S. patent application Ser. No. 763,853 filed Jan. 31, 1977 by Madland and Soddy and assigned to the same assignee as the instant invention, utilizes a gear-driven crank member in association with a hasp having an end opening. A stud or boss on the crank member is received in the end opening to drivingly interconnect the crank member and door. The end opening is elongated to accommodate the arcuate path of the stud. The instant invention eliminates the need for driving gears as required in the invention of Ser. No. 763,853 and provides a roller to minimize the counterproductive friction forces created by the stud while directing the driving forces normal to the opening defining cam surface.

As is apparent from the above, the primary reason for using a door driver is to exert a force to move the door into and out of a locking or closed position which force is sufficient to overcome binding forces between the railway car body or frame and the door. It is particularly desirable that this force is exerted by manual means and not by use of any auxiliary equipment which is expensive, time-consuming and, if not properly designed, may create additional damage to the door or railway car door frame. It is also desirable that the door driver be capable of moving the railway car door a substantial distance under such greater force. When a locking mechanism is utilized, it is also desirable to provide a door driver which is capable of slightly moving the door when it is in the approximate locking position so that the mechanism may be easily locked or released.

SUMMARY OF THE INVENTION

The present invention provides a door driver for moving a railway car door from an open or sliding position to a closed or locking position with a force which is substantially greater than a manual force exerted on the door driver to thereby overcome extreme binding between the railway car door and the railway car door frame. The door driver of the present invention is capable of exerting different desired magnitudes of such multiplied forces on the railway car door depending on the direction of rotation and the angular position of the crank arm so that the door may be easily moved between the sliding and locking positions even when the door or the railway car structural members are substantially damaged. The driver of the instant invention provides an appropriate force for the particular position and direction of movement of the door by means of a hasp opening defining cam surface and roller combination.

It should be understood from the outset that in its broadest sense, the door driver of the present invention may be used for either double or single door cars or cars with any number of doors. When used in conjunction with single car doors, the door driver is secured to a support or structural member of the railway car adjacent to the leading edge of the sliding door when it is in a completely closed or locking position. In double door combinations, one door may act as the support or structural member.

The door driver of the present invention includes a lever having a crank arm which is rotatably mounted on a structural member of the car adjacent to the leading edge of the railway car door when it is in the locking position. A boss in the form of a roller is mounted on the crank arm. The door driver further includes a door mounted hasp having a cam surface defined end opening for receiving said boss or roller selectively to drivingly interconnect said lever and said door. The cam surface provides theoretical mechanical advantages substantially within the range of from approximately 8 to 1, to approximately 46 to 1, ignoring friction. The particular magnitudes depending on the direction of rotation and the angular position of said crank arm to provide an appropriate force for the particular position and direction of movement of the door.

The mechanical advantages realized by such a door driver of the present invention is sufficient to overcome extreme binding between the door and the railway car member against which it is seated. The sliding door driver of the present invention is capable of exerting such a substantial force over a sufficient distance to move the door even when the door or railway car has been extremely damaged. The door driver of the present invention also allows the sliding door to be moved easily with a relatively high force when it is in the approximate locked position so that the lock mechanism may be easily locked or released.

It should also be understood that the sliding door of the present invention is capable of being utilized in conjunction with standard lock and sealing means without requiring any special adaptation thereof or any other special lock and sealing design.

Accordingly, it is an object of the present invention to provide a door driver for moving a railway car door between a closed or locking position and an open or sliding position by exerting an appropriate cam controlled force on the railway car door for the particular position and direction of movement of the door to move the door with a force sufficient to overcome extreme binding between the door and the member to which it is sealed.

It is still another object of the present invention to provide a door driver on a railway car for moving a railway car door between a closed or locking position and an open or sliding position which is capable of providing appropriate mechanical advantages of different desired magnitudes for moving said door for opening, closing, locking and unlocking said door.

Other objects and advantages of the present invention will be apparent from the following description and with reference to the annexed drawings in which like parts are designated by like numerals throughout the same.

DETAILED DESCRIPTION OF THE INVENTION

Figure 1:
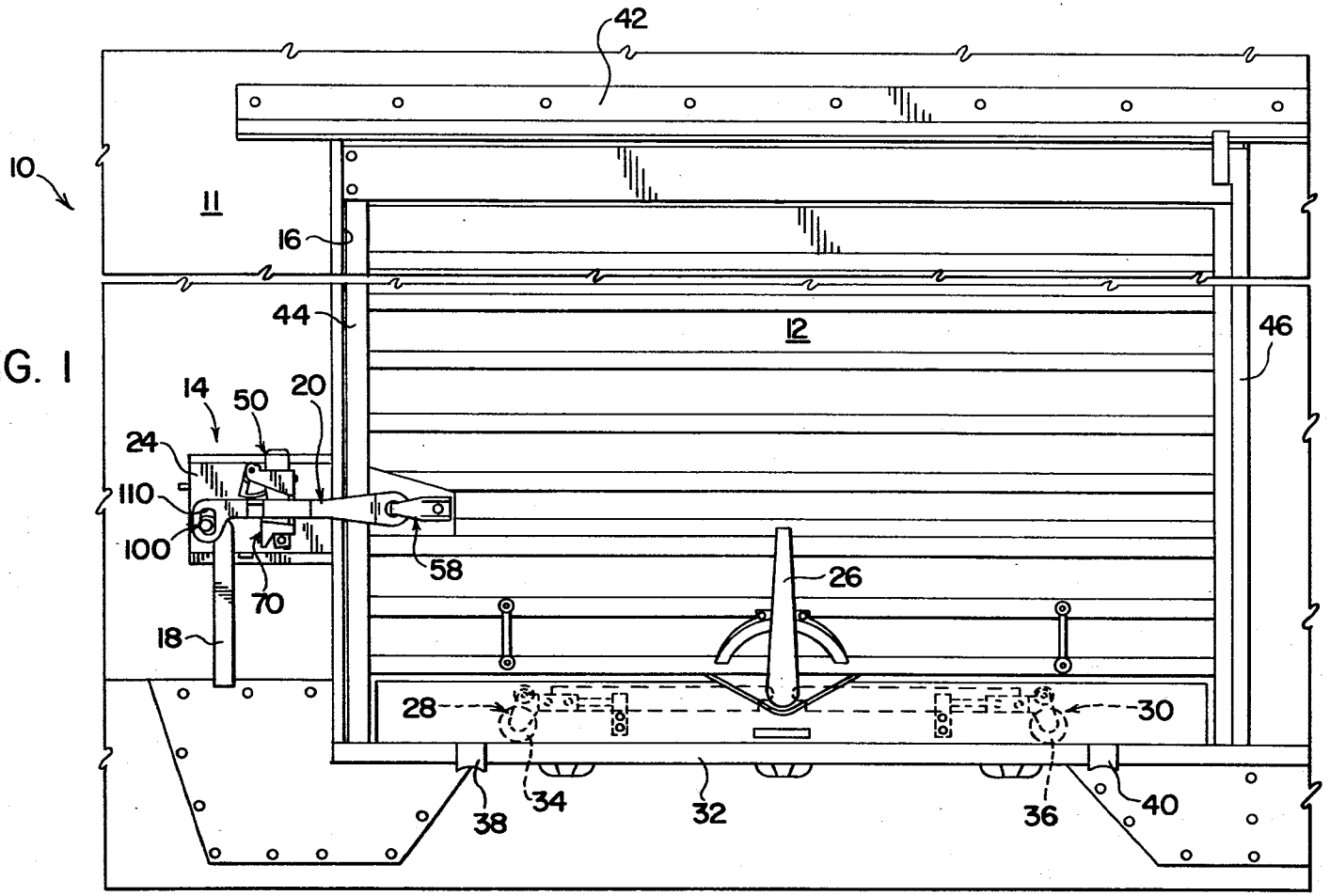
FIG. 1 is a front elevational view showing a door driver of the present invention applied to a single door construction of a railway car with the door in a closed or locked position.
Figure 2:
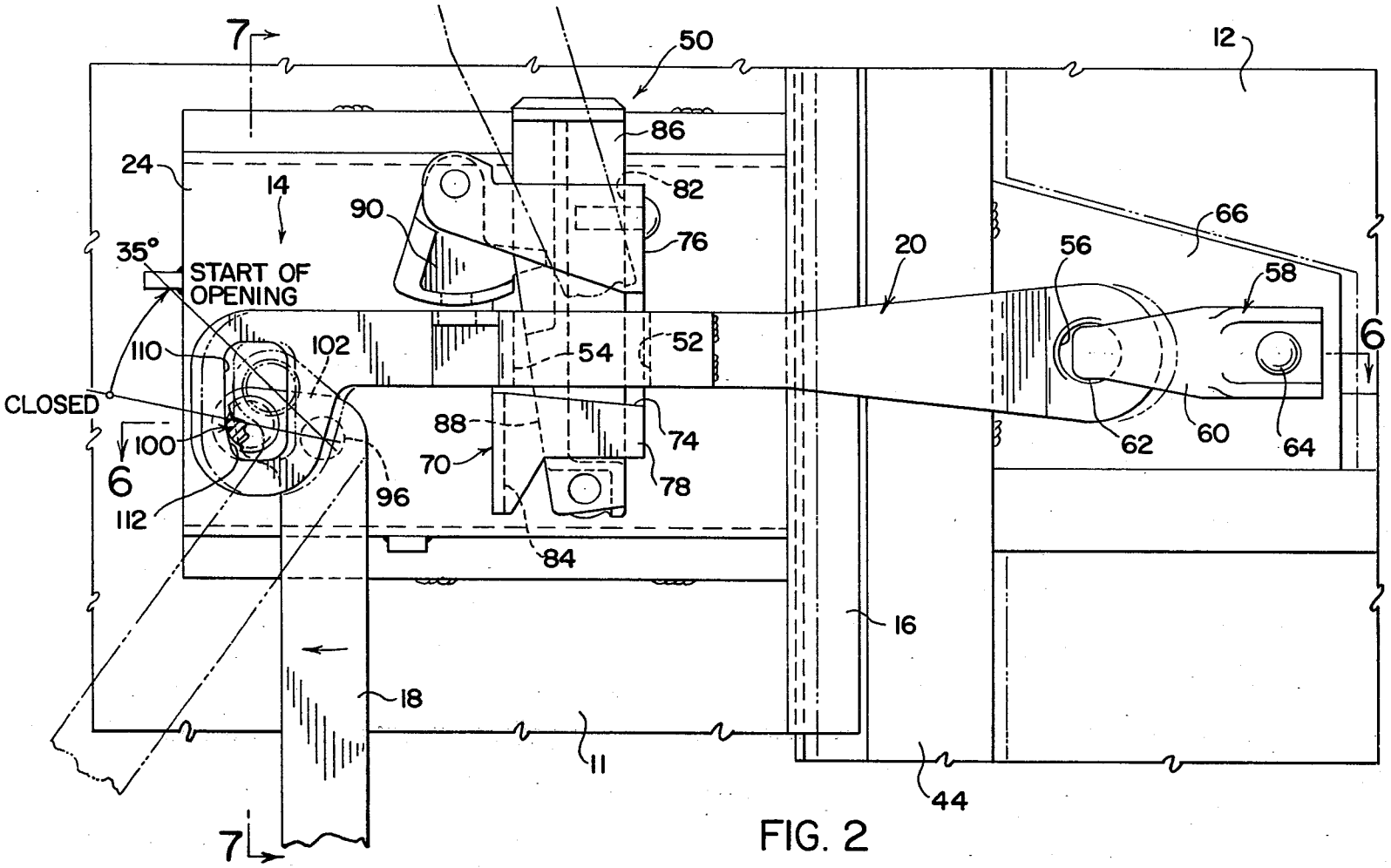
FIG. 2 is a detailed elevational view of the door driver shown in FIG. 1.
Figure 3:
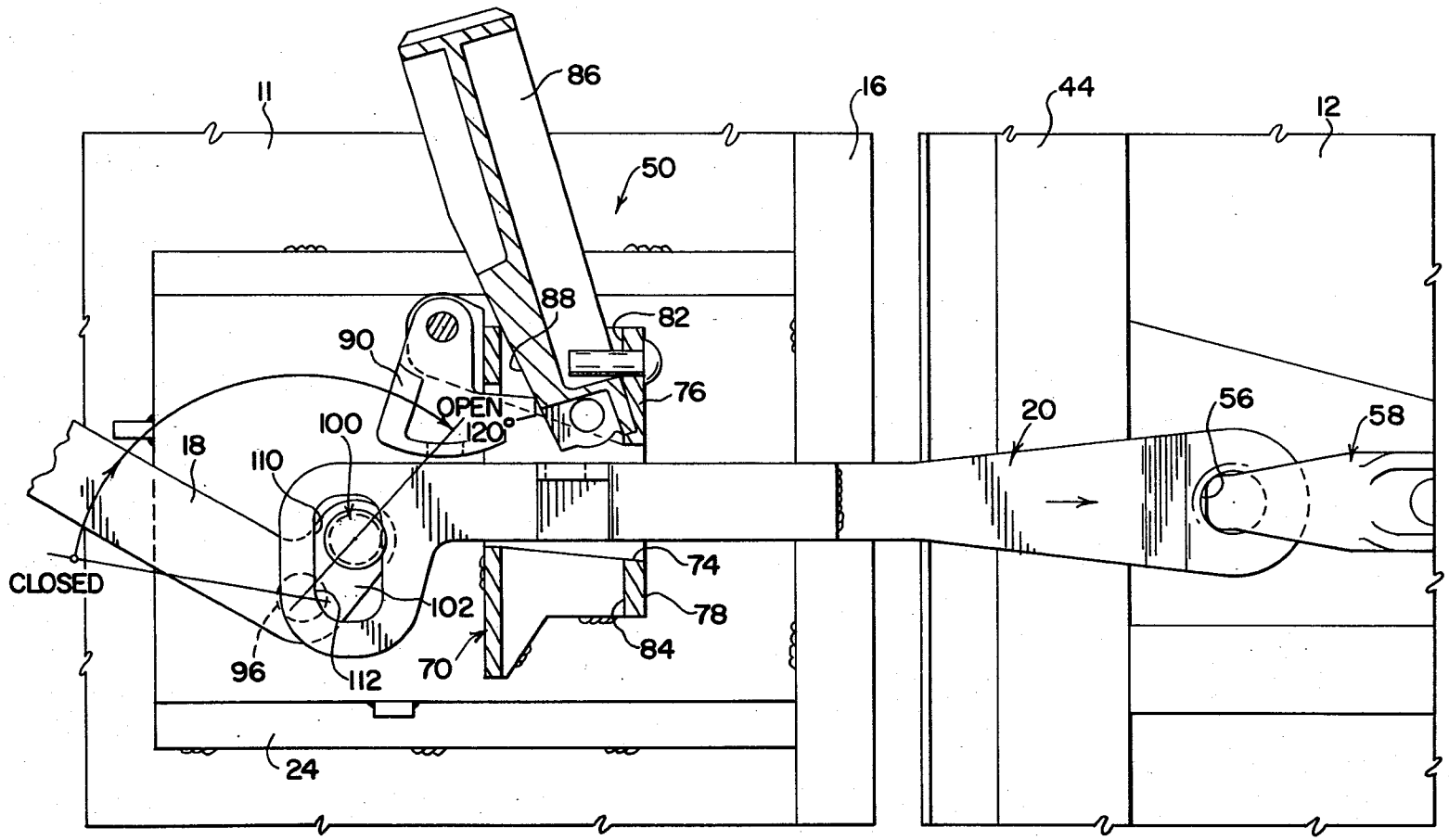
FIG. 3 is a detailed elevational view of the door driver of FIG. 1 with the railway car door in an unlocked and slightly opened position.
Figure 4:
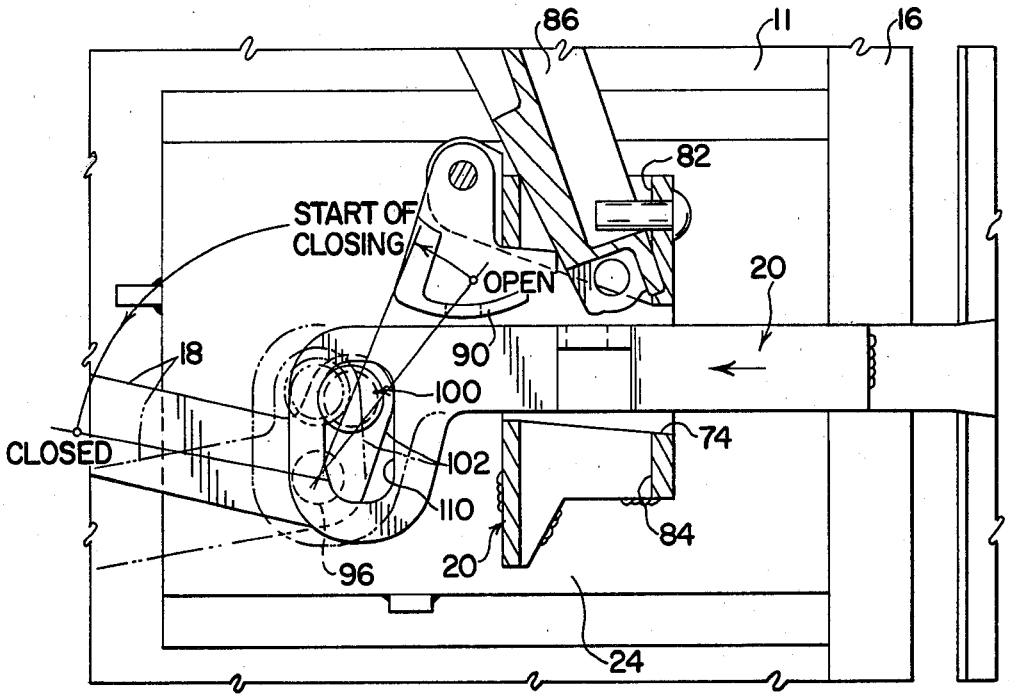
FIG. 4 is a detailed elevational view of the door driver shown in FIG. 1 with the door in a slightly closed position with a partially closed but not fully closed position in phantom.

In the drawings, a single door house car 10 is illustrated as having side sheathing 11 and a sliding door 12 with a novel door driver, generally designated by the numeral 14, as seen in FIG. 1. The railway car 10 has a door opening defining frame member or front stop 16. The door driver 14 of the present invention has a lever 18 and a hasp 20 which may be selectively interconnected for moving the railway car door 12 between a closed position in which the door may be locked as seen in FIG. 2 and another position in which the door is unlocked and slightly opened as generally indicated in FIG. 3. In the unlocked and slightly opened position of FIG. 3 when the lever 18 is disengaged from the hasp 20 which is mounted on the railway car door 12, the door 12 may be moved along the side of the railway car 10 to open the door opening completely so that cargo may be loaded into or unloaded from the railway car 10.

As described above, damage may occur to the door 12 during the loading and unloading process. Consequently, the door driver 14 is provided to urge the door 12 from the unlocked and slightly open position to the completely closed or locked position with a force sufficient to overcome any binding forces created by damaged portions of the door or other parts of the railway cars as will be hereinafter described.

The lever 18 of the door driver 14 is rotatably mounted for travel through an arc of 120 degrees on a hat-shaped mounting member 24 mounted adjacent to the door opening as best seen in FIG. 2. The hat-shaped mounting member 24 is secured as, for example, by means of welding to the side sheathing 11 of the house car 10.

The door 12 is of the type generally known in the art as a lift door and includes a handle 26 and corresponding lifting mechanisms 28 and 30 which operate in a manner known to those skilled in the art. The lifting mechanisms 28 and 30 engage a track 32 for selective movement thereon by means of rollers 34 and 36 respectively. The general structure of the door 12 includes bottom retainers 38 and 40 in engagement with the track 32 and a top retainer structure 42 in cooperation with other conventional structural members to hold the door in aligned position for sliding movement upon actuation of the lift mechanism by the lever 26. The door 12 has a forward or leading edge 44 and a rear edge 46.

Figure 6:
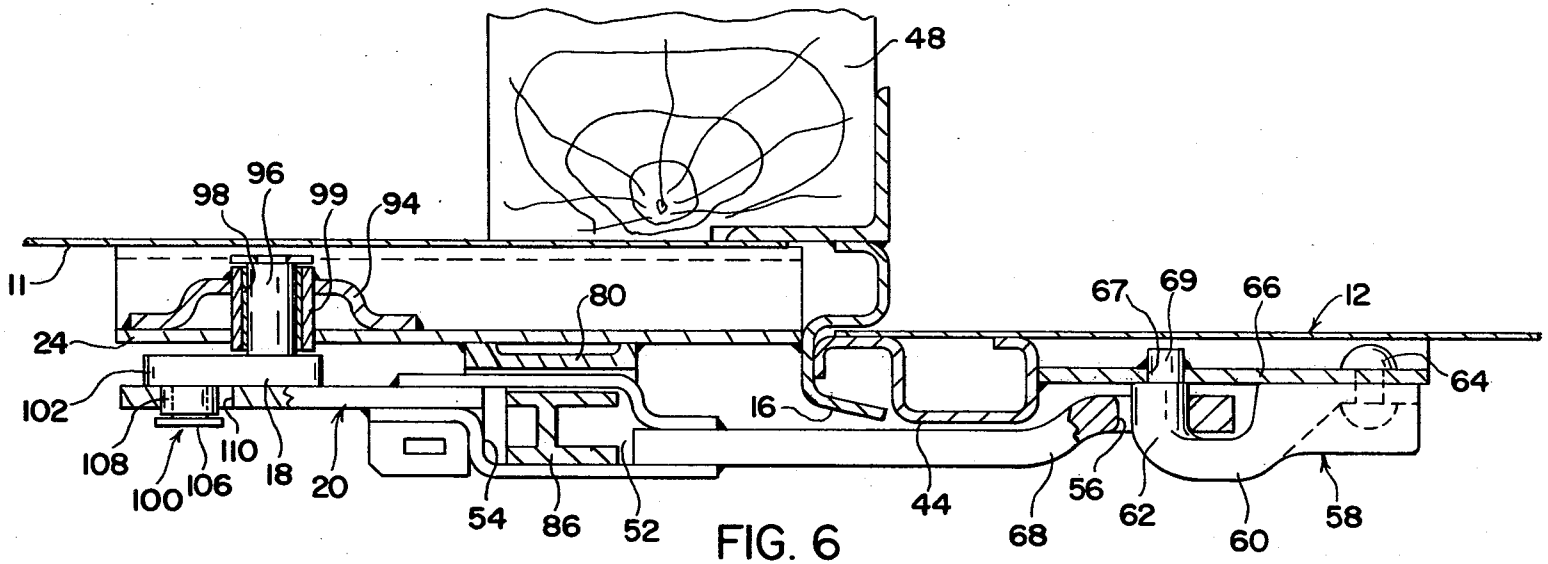
FIG. 6 is a cross-sectional view of the door driver shown in FIG. 2 taken along lines 6—6 thereof.
Figure 7:
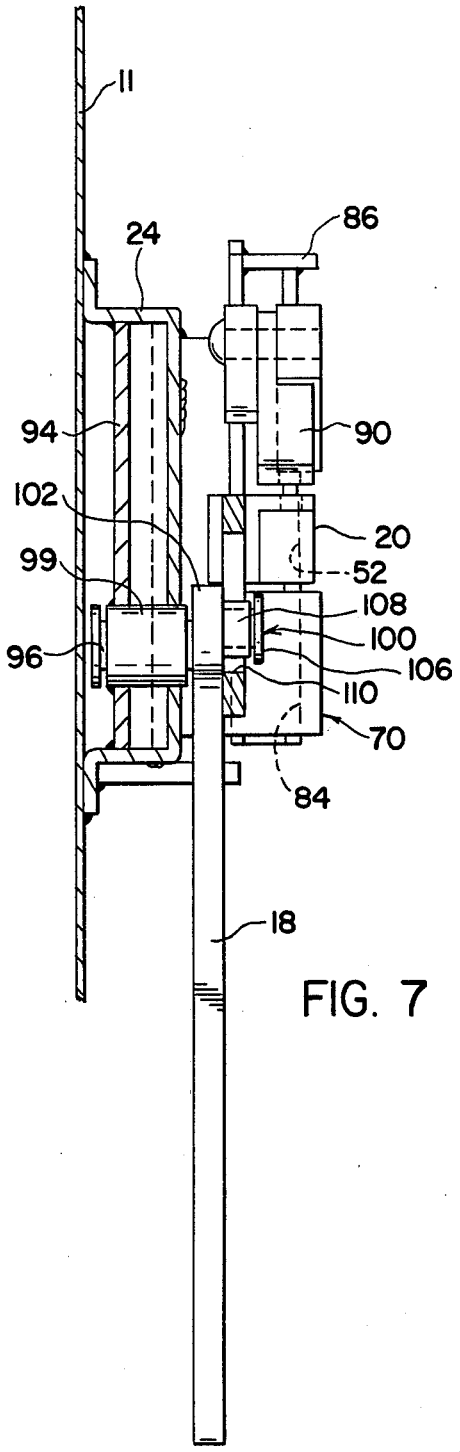
FIG. 7 is a cross-sectional view of the door driver shown in FIG. 2 taken along lines 7—7 thereof.

When the door is moved into a closed and locking position against front stop or door frame member 16, the rear edge 46 and the front edge 44 make a weathertight seal to close the door opening. The front stop 16 is mounted on a frontpost or fixed structure 48, as best seen in FIG. 6, in a manner well known to those skilled in the art.

The details of construction of the sliding door 12 and the surrounding structure as described are by way of environment and may be varied as will be readily recognized to those skilled in the art. As previously mentioned, for instance, the fixed structure including the front stop 16 may be functionally replaced by a second auxiliary door of a double door car. Accordingly, the door 12 represents either a single door or the main door of a double door car or of any other multiple car door.

A pin-type locking means, generally designated by the numeral 50, is provided to selectively lock and secure the door 12 in the closed position. The hasp 20 has a vertical opening 52 therethrough as best seen in FIG.

2. The vertical opening 52 has three substantially straight sidewall portions and forwardmost inner wall portion 54. The hasp 20 is pivotally mounted on the door 12 by means of a bore 56 in one end of the hasp which cooperates with a hasp fastener 58. The hasp fastener 58 is a plate-like member having a forwardly projection tongue 60 which forms an eyelet or closed curved bar portion at its end 62 which is of slightly smaller cross-sectional diameter than the diameter of the hasp bore 56. Accordingly, the hasp 20 is relatively loosely supported on the fastener 58 for vertical and lateral pivotal movement.

The hasp fastener 58 has a plurality of apertures through which rivets or other conventional fasteners 64 pass to secure the fasteners 58 to the panels of the door 12, as best seen in FIG. 6. Appropriate hasp fastener retaining plates and fillers 66 are interposed between the hasp fastener 58 and the surface of the door 12 to distribute the stresses and insure that the forces exerted on the hasp fastener by the hasp 20 will not damage the door 12 and pull the fastener from its seat. One of the hasp fastener retaining plates 66 has an aperture 67 therein for receiving the end portion 69 of the hasp fastener 58 and is secured therein by any conventional means such as welding.

It will be readily recognized that other means of securing the hasp fastener 58 to the door 12 may be utilized. The hasp 20 is of sufficient length that it projects from the end 62 of the hasp fastener 58 past the forward edge 44 of the door 12 and past the front stop 16. The vertical hasp opening 52 is located at a point intermediate the ends of the hasp 20. The hasp 20 has an appropriate contour including an S-shaped bend 68 to provide a clearance around the outermost projecting portion of the edge 44 of the door 12. Because of a relatively loose fit between the bore 56 and the holding member 62, disposed therein, the hasp 20 is free to pivot on a horizontal plane outwardly from the door a sufficient amount to insure clearance of these portions of the structure. The pivoting of the hasp 20 in a vertical direction is limited by locking means 50 when the lever 18 and hasp 20 are connected.

The locking means 50 is made up of two principal parts, a locking member 70 and a locking pin 86, as best seen in FIG. 2. The locking member 70 is mounted on the hat-shaped member 24 which is secured to the marginal portions of the sheathing 11. The locking member 70 has a generally channel-shaped slot 74 extending transversely across the locking member in a substantially horizontal direction to define an upper bracket portion 76 and a lower bracket portion 78 extending from the base 80. In the upper bracket portion 76 is a vertically oriented opening 82 and in the lower bracket portion 78 is a vertically oriented opening 84. The openings 82 and 84 are in substantially vertical alignment to provide a substantially vertical passage for receiving the locking pin 86.

The locking pin 86 is of such dimension as to permits its receipt in the openings 82 and 84 of the upper and lower brackets 76 and 78 respectively, and the channel 74 is adapted to receive the intermediate portion of the hasp 20 with its vertical opening 52 in substantial alignment with the openings 82 and 84. The hasp 20 is placed in this position by movement of the hasp laterally toward the locking member 70 through pivotal movement of the hasp on the hasp fastener bar 62 located in the enlarged, loosely fitting bore 56 at the end of the hasp. The surface 54 in the bore 52 of the hasp is adapted to cooperate with a tapered portion 88 on the pin 86 such that when the pin is in position and the vertical passage formed by the bores 82, 84 and 52, the pin 86 holds the hasp snuggly and firmly in place.

As seen in FIG. 2, a sealing cam 90 is received in a recess in pin 86 to positively prevent upward movement of the pin out of the locking position, and accordingly, it is required that sealing cam 90 be manually pivoted before the locking pin 86 may be lifted out of the openings 82, 84 to the point where the hasp 20 may be removed from the channel 74.

The door driver 14 includes a lever 18 which is rotatably mounted on the hat-shaped structural member 24. A vertical reinforcing member 94 spans between the legs of the hat-shaped member 24 and is welded thereto to provide a reinforcement of the member. The reinforcing member 94 and the hat-shaped member 24 to which it is connected have cylindrical openings in register to accommodate pivot pin 96. The pivot pin 96 is fixed at a position slightly below the point at which holding member 62 provides a pivot mount for hasp 20. Suitable bearing means to permit rotation of the lever 18 and its pin 96 are provided in the form of a bronze bushing 98 or other suitable anti-friction means. Bushing 98 is mounted within a cylinder 99 which is welded in the openings of the members 24 and 94.

A pivot pin or boss 100 is fixed to the outer end of crank arm portion 102 of lever 18. The boss means 100 is made up of a headed pin 106 and anti-friction roller 108 rotationally mounted thereon. The roller 108 acts as a cam follower and moves within a cam surface defined end opening 110 which is an elongated slot in the end of the hasp 20 transverse to its longitudinal length. The cam surface defined end opening or slot 110 is of a greater width than the diameter of the roller 108 to provide lost motion therebetween for purposes which will be seen in the description of operation to follow.

When the car is fully loaded and in locked condition as shown in FIG. 2, the lever 18 is vertically oriented and the crank arm 102 extends transversely at an angle to the horizontal of 10 degrees as measured from a line extending through the centers of pivot pin 96 and boss 100. In this position with the door locked, the first operation in order to open the door and gain access to the lading therein is to break the car seal and rotate the sealing cam 90 out of the recess pin 86. Pin 86 is then lifted to the position shown in phantom in FIG. 2 and in full in FIG. 3.

The lever 18 may be, for example, 14 inches long, and when manually grasped for rotation about the pivot pin 96 in a clockwise direction, receives a force approximately 12 inches from the pivot pin 96. This force acts to rotate the lever 18 and its crank portion 102 through an initial distance of 35 degrees. The boss 100 then assumes a position shown in phantom in FIG. 2 and has moved from the position adjacent the lower left portion of the cam surface 110 as seen in that figure to a position in the upper right portion of the cam surface 110. During most of this movement a condition of lost motion exists between the boss 100 and the slot 110 and the actual opening does not start until approximately 35 degrees of angular travel is accomplished.

Figure 5:
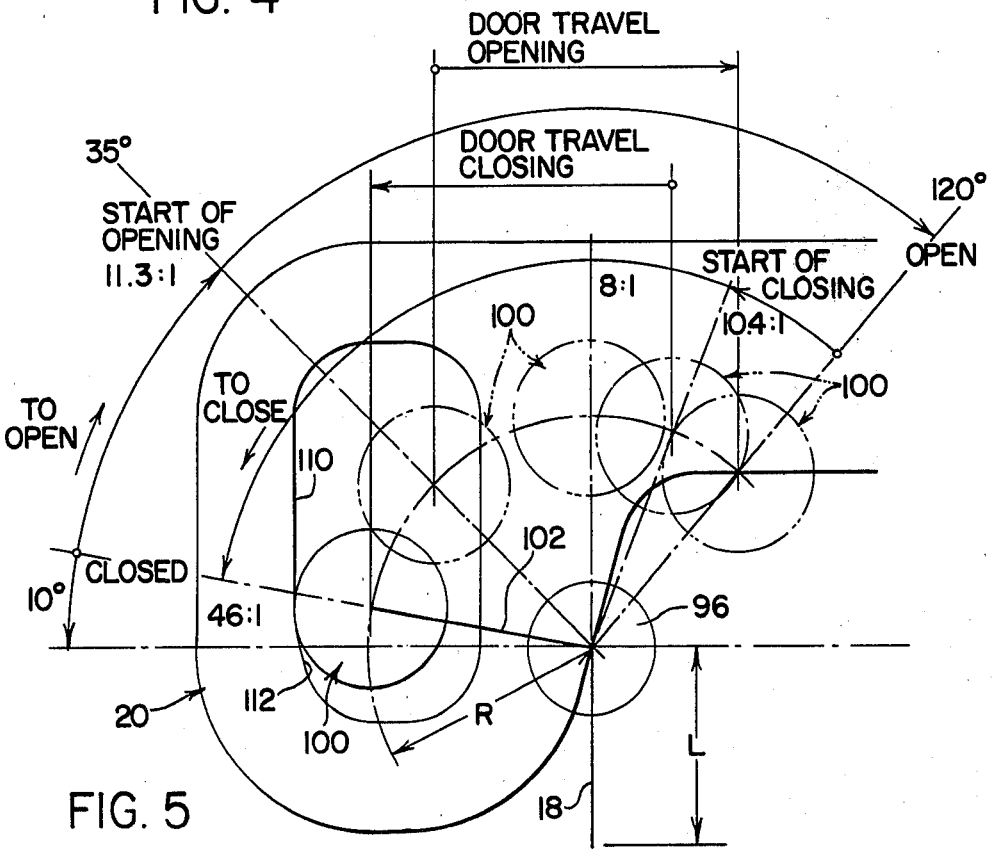
FIG. 5 is a schematic drawing of the various angular positions of the crank arm of the door driver with the door moving in different directions and at different positions to illustrate the different appropriate mechanical advantages obtained.

During this time a slight movement of the door 12 and its hasp 20 begins as seen in the phantom illustration of the hasp position in FIG. 2. This results in part from the spring action of the door stop 16 and in part in the mere release of the boss 100 from its locked position in slot 110 which will be seen from a careful perusal of the drawings to include a tapered surface portion 112 of the cam surface 110. Surface portion 112 provides the extremely high theoretical mechanical advantage locking force which, for example, in the illustrated embodiment is 46 to 1, ignoring friction. Movement of the boss 100 along surface portion 112 helps free pin 86 for lifting. A schematic illustration of this operation is seen in FIG. 5 where it will be seen that a continuation of the clockwise rotation of the lever 18 and its crank arm portion 102 will move the boss 100 in an arcuate path which in the illustrated embodiment has a radius of 1½ inches from the center of pivot pin 96.

When the crank arm has moved the boss 100 in its arcuate path 80 degrees to the top of the arc, the theoretical mechanical advantage in the instant example is reduced to 8 to 1, ignoring friction. At this point, the door travel in a longitudinal direction as created by the horizontally moving hasp 20 is more rapid since the horizontal component of motion is greater than the vertical component and is at its maximum. It will be recognized that when the crank arm 102 is moving the 35 degrees between the fully closed position at 10 degrees above the horizontal to the 45 degree position, the vertical component of movement of the crank boss 100 is greater than the horizontal component, resulting in the correspondingly higher theoretical mechanical advantages in that portion of the crank arm arc.

Continuing the clockwise rotation of the lever 18 will move the boss 100 past the vertical and the mechanical advantage will increase from 8 to 1 to 10.4 to 1, where the door will be fully unlocked and in an open condition and where the hasp 20 can be removed from its engagement with the boss 100. The door is then manually moved the remaining distance out from in front of the door opening for unloading. During this period of time, in the example given, the door travel will be a little in excess of two inches and the crank 102 will have moved 120 degrees.

When it is desired to close and lock the door 12, the door is moved from the fully open position to the position shown in FIG. 3 and the hasp 20 is pivotally placed in the slot 74 of the locking member 70 such that its transversely extending end opening 110 surrounds boss 100 on crank portion 102 of lever 18. When the hasp 20 is in the slot 74 of the locking member 70, hasp 20 is prevented from pivoting downwardly in the vertical plane as seen in FIG. 3. The moving of the door to the closed and locking position is then commenced by rotation of the lever 18 to drive the crank arm 102 from the fully open position in a counterclockwise direction. The initial starting in the opening direction, in the example and with the dimensions and forces given, is accomplished by means of a 10.4 to 1 theoretical mechanical advantage, ignoring friction, which as the crank arm is rotated to the vertical position becomes an 8 to 1 theoretical mechanical advantage, ignoring friction. This, as previously stated, permits relatively rapid movement of the door relative to the angular velocity of the crank arm 102. As the crank arm 102 continues in the counterclockwise direction to a position of 45 degrees from the horizontal it develops a theoretical mechanical advantage of 11.3 to 1, ignoring friction, and then as it moves to within 10 degrees of the horizontal, the distance travelled by the door per angle of rotation decreases and theoretical mechanical advantage increases to 46 to 1, ignoring friction. It is this final rapid increase in mechanical advantage which gives the relatively greater force as applied by boss 100 to surface portion 112 to clinch the leading edge of the door 44 against the stop 16 and align the openings of the locking means 50 so that the pin 86 may be wedged into proper locking engagement through hasp opening 52. With the door in this closed and locked condition, the sealing cam 90 may be moved counterclockwise into a recess in pin 86 and the car seal applied to provide a fully locked and sealed car for transit to its destination.

A mechanical analysis of the action of the crank arm 102 with the end defining cam surface or slot 110 will illustrate that because of the confining nature of slot 74 upon the hasp 20 during a portion of the rotation of the lever 18 a sliding movement of the door 12 is created which is analogous to that accomplished in a Scotch yoke mechanism. The mechanics of the operation of driving the hasp 20 by means of the cam surface 110 through boss 100 on crank arm 102 is made more efficient because of the roller 108 which acts according to the principals of mechanics to make all forces transferred from the crank arm 102 to the hasp 20 to act normal to the cam surface 110. This advantage of the roller, when taken with its anti-friction advantages, allows a mechanical advantage more nearly approaching its theoretical because little friction can act against the efficient force transfer as can be illustrated by the following moment balance example of forces acting about pivot pin 96 using the illustrated embodiment. Mechanical advantage equals the force output (Force hasp) divided by the force input (Force in).The symbol "u" is the coefficient of friction.

$$\text{Force in (12)} = \text{Force hasp } (1.5\ \text{SIN}\theta) + Fu\ (1.5\ \text{COS}\theta) \quad \text{(assume negligible)}$$

$$\text{Force in} = \text{Force hasp } \frac{1.5}{12}\ \text{SIN}\theta$$

$$\text{Mechanical advantage} = \frac{\text{Force hasp}}{\text{Force in}} = \frac{\text{Force hasp}}{\text{Force hasp } \frac{1.5}{12}\ \text{SIN}\theta}$$

$$= \frac{12}{1.5}\ \frac{1}{\text{SIN}\theta}$$

$$\text{Since } \frac{1}{\text{SIN}\theta} = \text{CSC}\theta,$$

At 90 degrees, for example, where the CSC$\theta$ is 1, the theoretical mechanical advantage is 8 to 1. As $\theta$ tends toward 0 (zero), that is, as the crank arm 102 tends toward the 10 degree position as described relative to FIG. 5, the cosecant increases to where at the 10 degree position it is 5.759, giving the theoretical mechanical advantage of 46 to 1.

In the above example, friction has been ignored. The applicable theoretical friction coefficient between the roller 108 and the slot could be as little as 0.0007 where for a steel boss riding on the steel surface of the cam surface 110 it could be as great as 0.3. The tremendous difference in ultimate theoretical mechanical advantage gained by use of the roller will be evident to those skilled in the art if calculated into the formula above as first given.

Accordingly, it has been possible to provide a compact door driver which urges a door between a sliding position and the locking position with a force that is appropriate for the particular position and direction of movement of the door.

I claim:

1. In a railway house car having a door opening and a door, a structural member adjacent said door opening and a mounting member secured to said structural member; a door driver for moving said door between a first and a second position comprising: a manually operable lever having a crank arm; said lever being rotatably mounted by means of said mounting member on said structural member for rotation through an arc of 120°; a boss on said crank arm; a hasp means having an end opening for receiving said boss; said hasp means end opening having a cam surface providing mechanical advantages of different desired magnitudes within a range of approximately 8 to 1, to approximately 46 to 1, ignoring friction, for opening, closing, locking and unlocking said door depending on the direction of rotation and the angular position of said crank arm to provide an appropriate force for the particular position and direction of movement of the door; and said hasp means in selective interconnection with said boss on said crank arm when said lever is in a vertical position thereby selectively to maintain said door in a closed and locked position in a condition of relative great mechanical advantage urging said boss in said hasp means end opening during the locking operation relative to the unlocking operation.

2. The combination of claim 1 means for limiting the pivotal movement of said hasp means about its mount on the door and said cam surface defining a slot transverse to the length of the hasp means such that said boss reciprocates in said slot during opening, closing, locking and unlocking operations.

3. The combination of claim 2 in which said slot and hasp means act with the crank arm and boss similar to the manner of a Scotch yoke mechanism to produce sliding motion to close said door.

4. The combination of claim 2 in which said slot is of a width which permits lost motion between said boss and said cam surface to permit rapid movement of said boss from the fully closed position of high mechanical advantage and slower door movement to a position of less mechanical advantage and more rapid door movement for opening.

5. The combination of claim 1 in which said boss is a roller acting as a cam follower within said cam surface to minimize frictional forces acting against the forces generated by said cam surface during opening, closing, locking and unlocking said door.

* * * * *